US006292109B1

(12) United States Patent
Murano et al.

(10) Patent No.: US 6,292,109 B1
(45) Date of Patent: Sep. 18, 2001

(54) INTERSECTION INFORMATION SUPPLY SYSTEM AND ONBOARD INFORMATION TRANSMISSION APPARATUS APPLICABLE THERETO

(75) Inventors: Takahiko Murano; Akihide Tachibana, both of Susono (JP)

(73) Assignee: Toyota Jidosha Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 09/160,265

(22) Filed: Sep. 25, 1998

(30) Foreign Application Priority Data

Sep. 29, 1997 (JP) ..... 9-264523

(51) Int. Cl.[7] ..... G08G 1/16
(52) U.S. Cl. ..... 340/903; 340/902; 340/907
(58) Field of Search ..... 340/902, 903, 340/907, 436

(56) References Cited

U.S. PATENT DOCUMENTS 4,321,589 * 3/1982 King .
5,926,114 7/1999 Andrews .

FOREIGN PATENT DOCUMENTS 62-57097 3/1987 (JP) .
5-20599 1/1993 (JP) .
5-28400 2/1993 (JP) .
9-180095 7/1997 (JP) .

* cited by examiner

*Primary Examiner*—Theodore M. Blum
(74) *Attorney, Agent, or Firm*—Finnegan, Henderson, Farabow, Garrett & Dunner, L.L.P.

(57) ABSTRACT

An intersection information supply system supplies information about a first vehicle approaching an intersection on a first road to a driver of a second vehicle approaching the intersection on a second road, the first road and the second road intersecting at the intersection, wherein the intersection information supply system includes: a transmission unit, provided in the first vehicle, transmitting a predetermined signal when the first vehicle approaches the intersection; a receiving unit, installed near the intersection, receiving the predetermined signal from the transmission unit provided in the first vehicle; and an information supply unit supplying information to the second vehicle approaching the intersection on the second road when the receiving unit receives the predetermined signal, the information indicating that there is the first vehicle approaching the intersection on the first road.

8 Claims, 10 Drawing Sheets

INTERSECTION INFORMATION SUPPLY SYSTEM AND ONBOARD INFORMATION TRANSMISSION APPARATUS APPLICABLE THERETO

BACKGROUND OF THE INVENTION

1. Field of the Invention

The present invention generally relates to an intersection information supply system supplying information about whether a vehicle is going to pass through an intersection, and more particularly to an intersection information supply system supplying information about whether a vehicle running on a preferred road is going to pass through an intersection at which the preferred road and a non-preferred road intersect, to a vehicle running on the non-preferred road. In addition, the present invention relates to an onboard information transmission apparatus applicable to the above intersection information supply system.

2. Description of the Related Art

Conventionally, such an intersection information supply system is disclosed, for example, as an encounter collision avoidance display apparatus, in Japanese Laid-Open Patent Application No.5-28400. In this system, when a vehicle running on a preferred road is detected at a position a predetermined distance before an intersection at which the preferred road and a non-preferred road intersect, a light of a warning display board installed at a position from which a driver of a vehicle approaching the intersection on the non-preferred road can look at the lamp is turned on.

According to such a conventional system, even if buildings causes the visibility at the intersection to be poor, the driver of the vehicle approaching the intersection on the non-preferred road can recognize, based on the turned-on lamp of the warning display board, that a vehicle is approaching the intersection on the preferred road. Thus, the vehicle can more safely enter the preferred road from the non-preferred road.

A detector used to detect vehicles approaching the intersection on the preferred road can not distinguish the vehicles from other moving bodies. Thus, in a case in which bicycles or pedestrians are detected by the detector, the lamp of the warning display board is turned on. The detector detects the presence of moving bodies. Thus, if a body moving away from the intersection is in a detecting area of the detector, the detector detects the body. In this case, based on the detecting result, the lamp of the warning display board is turned on.

As has been described above, the conventional intersection information supply system does not necessarily supply useful information to the driver of the vehicle approaching the intersection on the non-preferred road.

SUMMARY OF THE INVENTION

Accordingly, a general object of the present invention is to provide a novel and useful intersection information supply system in which the disadvantages of the aforementioned prior art are eliminated.

A more specific object of the present invention is to provide an intersection information supply system which can certainly supply information about presence of a vehicle approaching, on a first road, an intersection at which the first road and a second road intersect, to a driver of a vehicle approaching the intersection on the second road.

The above objects of the present invention are achieved by an intersection information supply system supplying information about a first vehicle approaching an intersection on a first road to a driver of a second vehicle approaching the intersection on a second road, the first road and the second road intersecting at the intersection, the intersection information supply system comprising: a transmission unit, provided in the first vehicle, transmitting a predetermined signal when the first vehicle approaches the intersection; a receiving unit, installed near the intersection, receiving the predetermined signal from the transmission unit provided in the first vehicle; and an information supply unit supplying information to the second vehicle approaching the intersection on the second road when the receiving unit receives that predetermined signal, the information indicating that there is the first vehicle approaching the intersection on the first road.

The information supply unit may be formed as a display apparatus which displays information, indicating the presence of the first vehicle approaching the intersection on the first road, in a state where a driver of the second vehicle approaching the intersection on the second road can look at the displayed information.

Although, in general, the first road is a preferred road and the second road is a non-preferred road, the first and second roads are not limited to such a case. For example, the first road may be the non-preferred road and the second road may be the preferred road. Further, both the first and second road may be the non-preferred roads.

At the intersection, at least the first and second roads may intersect. Thus, the present invention may be applicable, for example, to an intersection of three roads and to an intersection of five roads.

According to the present invention, only when there is the first vehicle approaching the intersection on the first road, is the information indicating the presence of the first vehicle supplied to the second vehicle approaching the intersection on the second road. Thus, the information about presence of a vehicle approaching, on a first road, an intersection at which the first road and a second road intersect can be supplied to a driver of a vehicle approaching the intersection on the second road.

To be capable of supplying information indicating from which side of the intersection a vehicle is approaching the intersection, the present invention may be the intersection information supply system described above wherein the predetermined signal transmitted by the transmission unit includes information indicating from which side of the intersection the first vehicle is approaching the intersection, and wherein the information supply unit comprises: means for determining, based on the predetermined signal received by the receiving unit, from which side of the intersection the first vehicle is approaching the intersection, wherein the information supply unit supplies information to the second vehicle, the information indicating that there is the first vehicle approaching the intersection from the determined side of the intersection.

Another object of the present invention is to provide an onboard information transmission apparatus applicable to the above intersection information supply system.

The above object of the present invention is achieved by an onboard information transmission apparatus provided in a vehicle comprising: approaching detecting means for detecting that the vehicle approaching an intersection on a first road reaches a position a predetermined distance before the intersection, the first road and a second road intersecting at the intersection: and signal transmission means for transmitting a predetermined signal when the approaching detecting means detects that the vehicle reaches the position the predetermined distance before the intersection, wherein the predetermined signal transmitted by the signal transmission means is used to supply information, indicating that there is the vehicle approaching the intersection on the first road, to another vehicle approaching the intersection on the second road.

The approaching detecting means may be means for detecting a body (e.g., a magnetic marker) installed at the position the predetermined distance before the intersection on the first road. The approaching detecting means may also be means for detecting an absolute position of the vehicle based on information from a car-navigation system.

To be capable of supplying information indicating from which side of the intersection the vehicle is approaching the intersection, the present invention may be the onboard information transmission apparatus wherein the approaching detecting means has means to detecting from which side of the intersection the vehicle reaches the position the predetermined distance before the intersection, wherein the predetermined signal transmitted by the signal transmission means includes information indicating that the vehicle is approaching the intersection from a side based on the detecting result obtained by the means.

To be capable of selectively supplying information about the vehicle approaching the intersection on the first road in a running state useful for another vehicle approaching the intersection on the second road, the present invention may be the onboard information transmission apparatus further comprising: running state detecting means for detecting a running state of the vehicle; and transmission control means for controlling, based on the detecting result obtained by the running state detecting means, whether the signal transmission means transmits the predetermined signal.

The running state may be represented by a running speed, an acceleration, a time period needed to reach the intersection or the like. For example, to control, based on a time period needed to reach the intersection, whether the predetermined signal is transmitted, the present invention may be the onboard information transmission apparatus wherein the running state detecting means comprises time estimating means for estimating a time period from a time when the approaching detecting means detects that the vehicle reaches the position the predetermined distance before the intersection to a time when the vehicle reaches the intersection, and wherein the transmission control means comprises: determination means for determining whether the time period obtained by the time estimating means is less than a predetermined value, the signal transmission means being caused to transmit the predetermined signal when the determination means determines that the estimated time period is less than the predetermined value.

According to such an onboard information transmission apparatus, in a case where the vehicle is more rapidly approaching the intersection, the information indicating the presence of the vehicle can be supplied to another vehicle approaching the intersection on the second road.

To be capable of supplying the information indicating that a group of vehicles ranged at short intervals is approaching the intersection, the present invention may be the onboard transmission apparatus further comprising: following-vehicle-state detecting means for detecting a presence state of one or a plurality of following vehicles in a rearward area of the vehicle; and vehicle-group-information generating means for generating, based on the presence of the one or the plurality of following vehicles detected by the following vehicle state detecting means, information about a vehicle group of the vehicle and the one or the plurality of following vehicles, wherein the predetermined signal transmitted by the signal transmission means includes the information about the vehicle group generated by the vehicle group information generating means.

The presence state of the one or the plurality of following vehicles includes at least information indicating the number of the one or the plurality of following vehicles. The information about the vehicle group includes at least information indicating the total number vehicles (the vehicle and the following vehicles) included in the vehicle group.

According to the present invention, an onboard information transmission apparatus is applicable to the intersection information supply system as described above.

BRIEF DESCRIPTION OF THE DRAWINGS

Other objects, features and advantages of the present invention will be apparent from the following description when read in conjunction with the accompanying drawings, in which.

DESCRIPTION OF THE PREFERRED EMBODIMENTS

A description will be given of an embodiment of the present invention.

Figure 1:
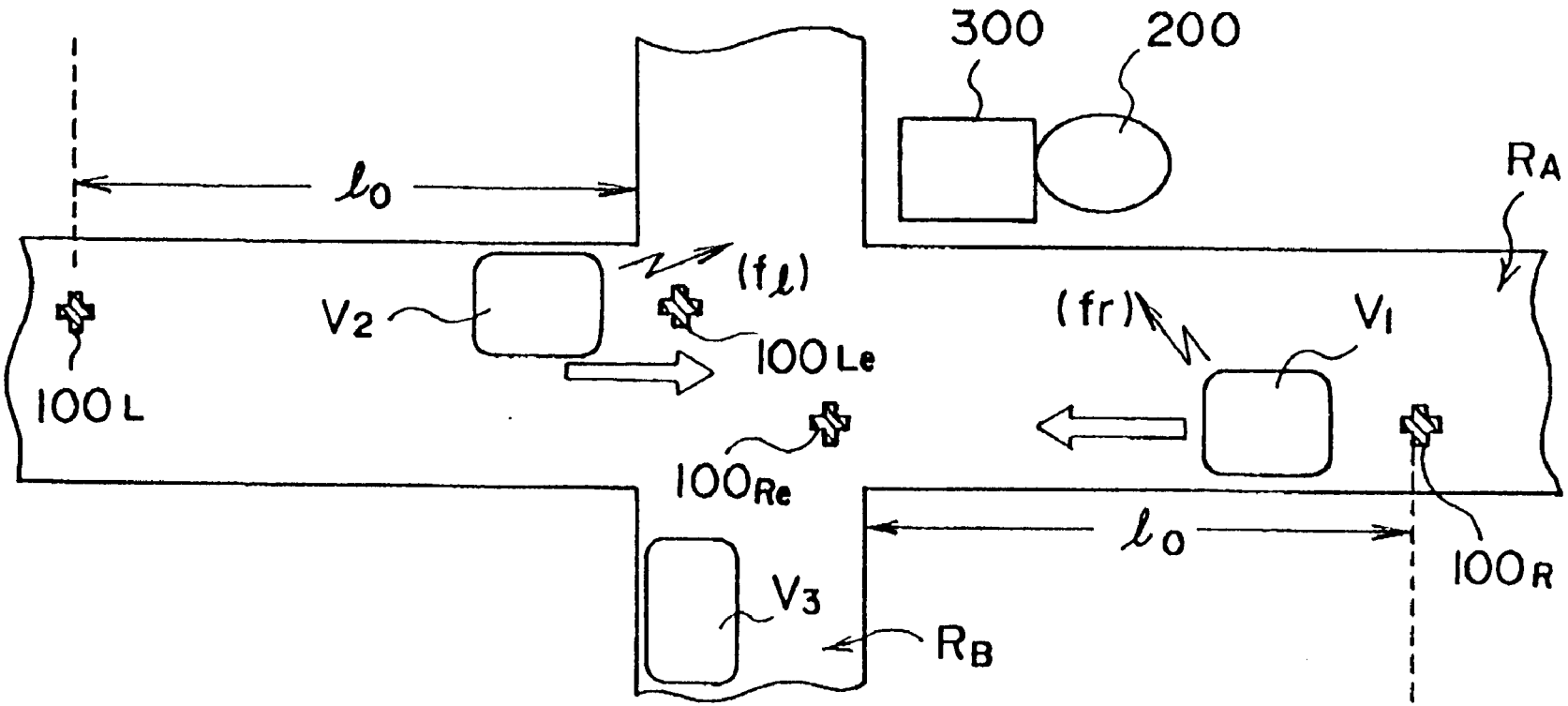
FIG. 1 is a diagram illustrating an example of an intersection to which an intersection information supply system according to an embodiment of the present invention is applied.

FIG. 1 shows a state of an intersection to which an intersection information supply system according to the embodiment of the present invention is applied.

Referring to FIG. 1, a receiving apparatus 200 is installed near an intersection at which a preferred road $R_A$ and a non-preferred road $R_B$ intersect. A display apparatus 300 is installed at a position at which a driver of a vehicle V3 approaching the intersection on the non-preferred road $\mathbf{100}_L$ can look at it. Magnetic markers $\mathbf{100}_R$ and $\mathbf{100}_L$ are respectively installed at positions $l_o$ meters before the intersection in lanes of the preferred road $R_A$. Each of the magnetic markers $\mathbf{100}_R$ and $\mathbf{100}_L$ is formed, for example, of a plurality of magnets. The polarizing pattern (N-S-N, S-N-S or the like) of the magnetic field formed by the plurality of magnets represents on which side (the right side or the left side in FIG. 1) of the intersection the magnetic marker is installed. In addition, magnetic markers $\mathbf{100}_{Re}$ and $\mathbf{100}_{Le}$ which respectively pair with the magnetic markers $\mathbf{100}_R$ and $\mathbf{100}_L$ are installed in the intersection.

The respective magnetic markers $\mathbf{100}_R$ and $\mathbf{100}_L$ are set, for example, at positions 30 meters before the intersection ($l_o$=30). Each of these positions is decided in consideration of a situation in which if a vehicle running on the preferred road $R_A$ at a speed of 60 km/h starts rapidly braking at the position with a deceleration of −0.8 G, the vehicle can avoid collision with a vehicle approaching the intersection on the non-preferred road $R_B$.

Figure 2:
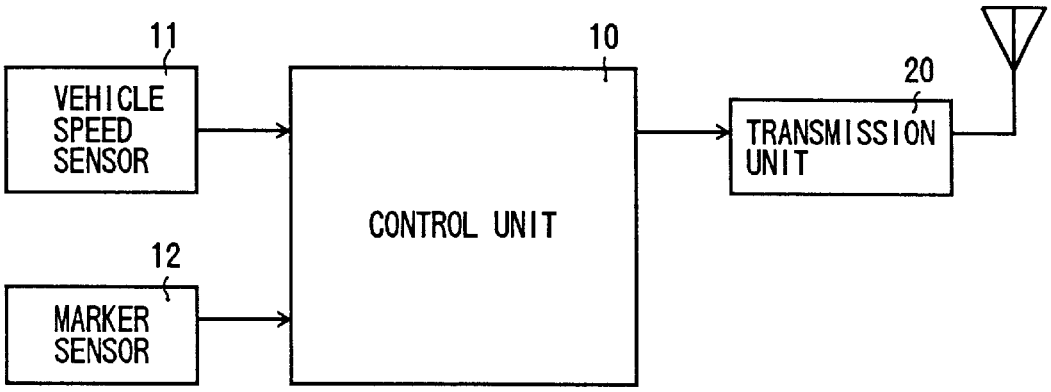
FIG. 2 is a block diagram illustrating an example of a constitution of an onboard information transmission unit used in the intersection information supply system.

In order to contribute to the intersection information supply system, each of vehicles (AHS vehicles) V1 and V2 is provided with an onboard transmission apparatus as shown in FIG. 2.

Referring to FIG. 2, the onboard information transmission apparatus has a control unit 10 and a transmission unit 20. A detecting signal from a vehicle speed sensor 11 and a detecting signal from a marker sensor 12 are supplied to the control unit 10. The marker sensor 12 detects the polarizing pattern from the magnetic marker installed on the preferred road $R_A$ and outputs the detecting signal. The control unit 10 carries out driving control and output frequency control of the transmission unit 20 based on the supplied detecting signals.

Figure 3:
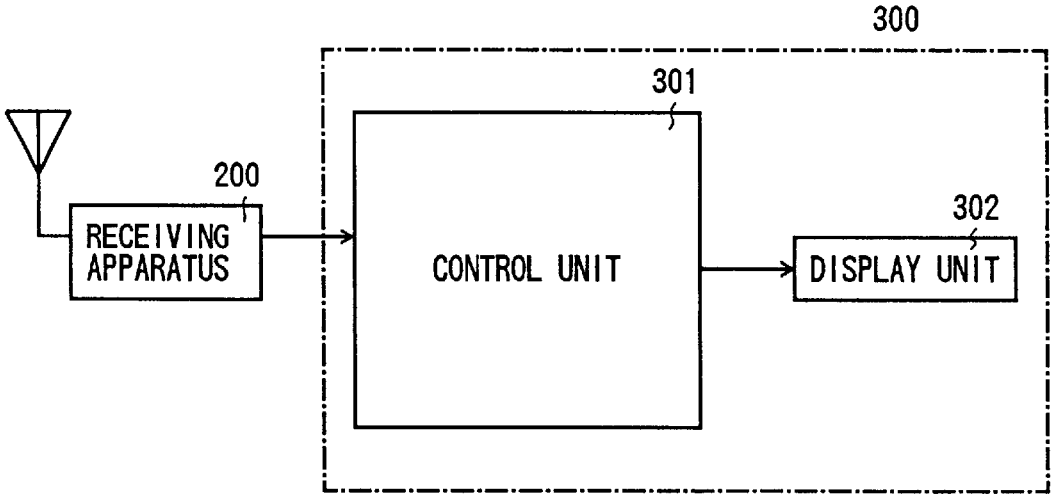
FIG. 3 is a block diagram illustrating an apparatus installed on roadside in the intersection information supply system.

The display apparatus 300 installed at the position at which the driver of the vehicle V3 approaching the intersection on the non-preferred road $R_B$ can see the display apparatus 300 is formed as shown in FIG. 3. That is, the display apparatus 300 has a control unit 301 and a display unit 302. The received signal from the receiving apparatus 200 is supplied to the control unit 301. The control unit 301 carries out display control of the display unit 302 based on the received signal.

Figure 4:
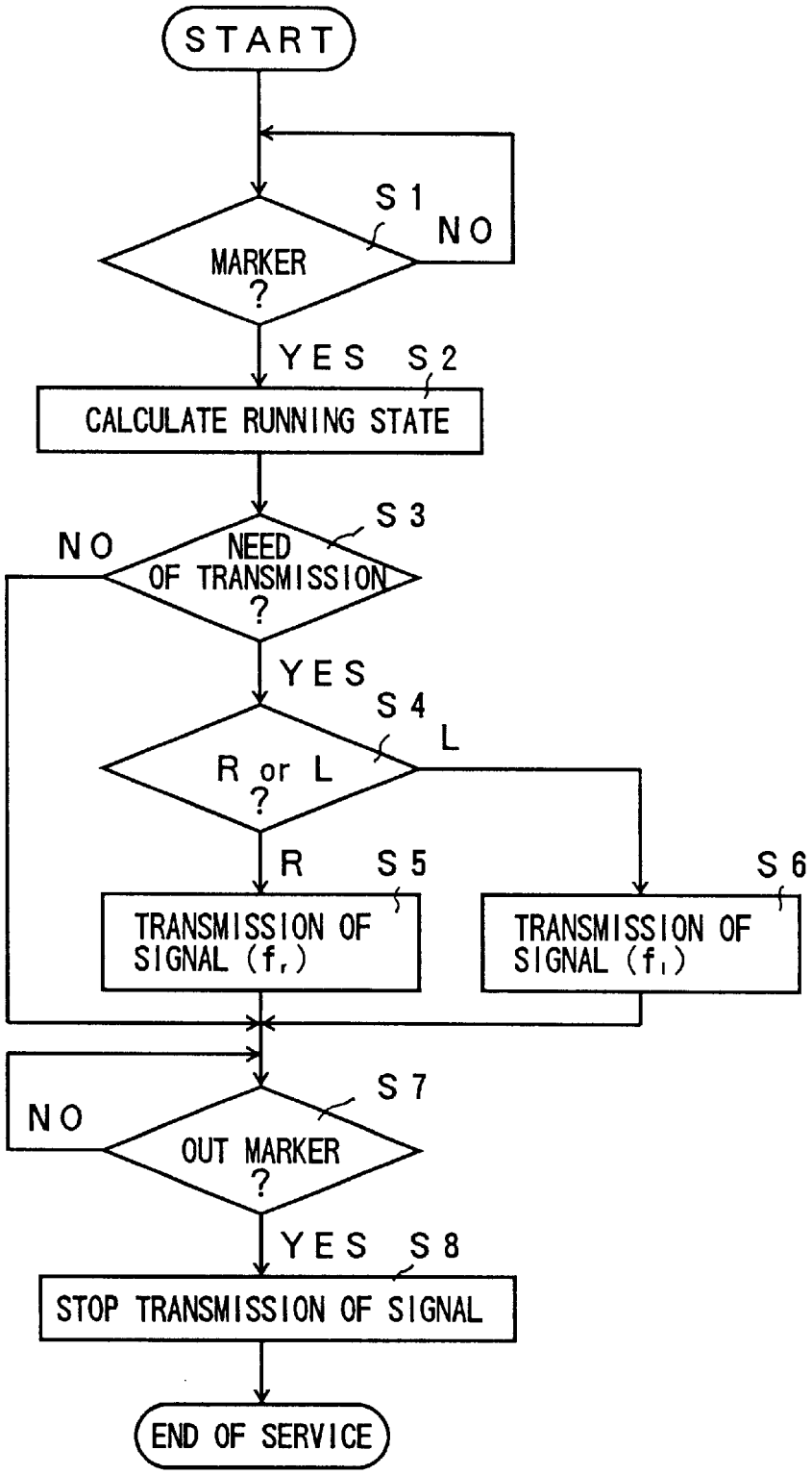
FIG. 4 is a flowchart illustrating a procedure of a process executed by a control unit of the onboard information transmission unit shown in FIG. 2.

The control unit 10 of the onboard information transmission apparatus carries out a process in accordance with a procedure as shown in FIG. 4.

Referring to FIG. 4, while the vehicle V1 or V2 is running, the control unit 10 watches the output signal from the marker sensor 12 and determines whether the magnetic marker $\mathbf{100}_R$ or $\mathbf{100}_L$ is detected (S1). When the magnetic marker $\mathbf{100}_R$ or $\mathbf{100}_L$ is detected, the running state is calculated based on the detecting signal from the vehicle speed sensor 11 (S2). The running state is represented, for example, by a time t required for the vehicle from the position of the magnetic marker $\mathbf{100}_R$ or $\mathbf{100}_L$ to reach the intersection. The time t is calculated in accordance with the following equation, $$t=[(-v_o+(v_o^2+2al_o)^{1/2}]a$$

where $l_o$ (meters) is a distance between the intersection and the magnetic marker ($\mathbf{100}_R$ or $\mathbf{100}_L$), $v_o$ (m/s) is a vehicle speed of the vehicle at the position of the magnetic marker $\mathbf{100}_R$ or $\mathbf{100}_L$ and "a" (m/s$^2$) is an acceleration of the vehicle.

A case where the calculated time t is short means that a time required for the vehicle V1 or V2 to reach the intersection is short. In this case, the necessity that a vehicle approaching the intersection on the non-preferred road $R_B$ is informed that the vehicle V1 or V2 is approaching the intersection on the preferred road $R_A$ is high.

After such a running state of the vehicle V1 or V2 is calculated, it is determined whether a signal to inform of the presence of a vehicle in such a running state should be transmitted (S3). Specifically, it is determined whether the time t calculated as a parameter representing the running state Is equal to or less than a predetermined reference time T. If the time t is equal to or less than the reference time T (the necessity of informing of the presence of such a vehicle is high), it is further determined, based on the polarizing pattern of the magnetic field detected by the marker sensor 12, from which side of the intersection the vehicle is approaching (S4).

If the vehicle is approaching the intersection from the side with the magnetic marker $\mathbf{100}_R$ (the right side of the intersection in FIG. 1), the control unit 10 supplies a control signal to the transmission unit 20 to transmit a radio signal having a frequency $f_r$ (S5). As a result, the radio signal having the frequency $f_r$ is transmitted from the transmission unit 10 provided in the vehicle V1. On the other hand, if the vehicle is approaching the intersection from the side with the magnetic marker $\mathbf{100}_L$ (the left side of the intersection in FIG. 1), the control unit 10 supplies a control signal to the transmission unit 20 to transmit the radio signal having a frequency $f_1$ (S6). As a result, the radio signal having the frequency $f_1$ is transmitted from the transmission unit 10 provided in the vehicle V2.

After this, it is repeatedly determined whether the magnetic marker $\mathbf{100}_{Re}$ or $\mathbf{100}_{Le}$ is detected (S7), and the vehicle V1 or V2 is running toward the intersection on the preferred road $R_A$.

On the other hand, if the time t is greater than the reference time T (the necessity of informing of the presence of a vehicle is low) (No in S3), a signal is not transmitted by the transmission unit 20. After this, it is repeatedly determined whether the magnetic marker (an out marker) $\mathbf{100}_{Re}$ or $\mathbf{100}_{Le}$ has been reached.

If it is determined, based on the detecting signal from the marker sensor 12, that the magnetic marker $\mathbf{100}_{Re}$ or $\mathbf{100}_{Le}$ is detected, the control unit 10 outputs a control signal to the transmission unit 20 to stop the transmission of the radio signal (S8). As a result, the transmission unit 20 stops transmitting the signal having the frequency $f_r$ or $f_1$. The vehicle V1 or V2 then passes through the intersection.

Figure 5:
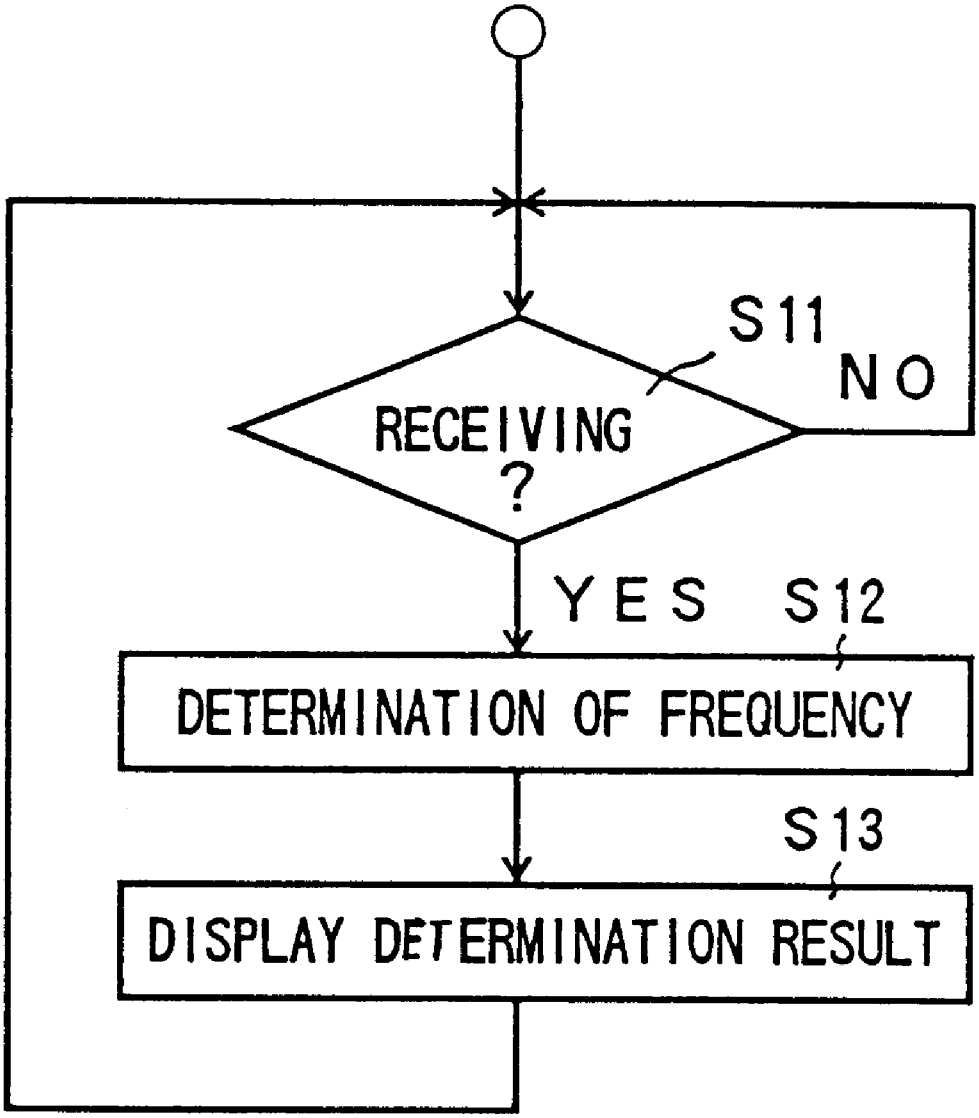
FIG. 5 is a flowchart illustrating a procedure of a process executed by a control unit of the roadside apparatus shown in FIG. 3.

In the above situation, the control unit 301 of the display apparatus 300 carries out a process in accordance with a procedure as shown in FIG. 5.

Referring to FIG. 5, the control unit 301 usually determines whether the receiving apparatus 200 receives a signal from the vehicle V1 or V2 running on the preferred road $R_A$ (S11). If it is determined that the receiving apparatus 200 receives the signal, it is further determined which frequency, $f_r$ or $f_1$, the received signal has (S12). The control unit 301 supplies display information based on the determination result to the display unit 302 (S13).

Figure 6:
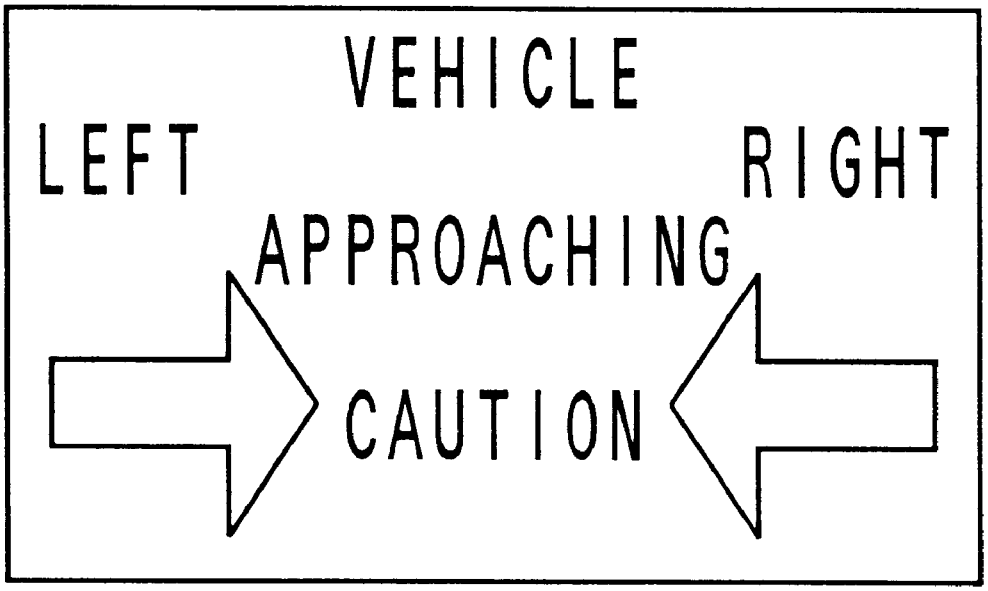
FIG. 6 is a diagram illustrating an example of information displayed by a display unit of the roadside apparatus.

If it is determined that the received signal has the frequency $f_r$, information indicating that there is a vehicle approaching the intersection from the side with the magnetic marker $\mathbf{100}_R$ on the preferred road $R_A$ is supplied to the display unit 302. As a result, the display unit 302 lights, as shown in FIG. 6, a direction indicator "RIGHT" and a corresponding arrow mark "⇦" The driver of the vehicle V3 approaching the intersection on the non-preferred road $R_B$ (see FIG. 1) looks at the direction indicator "RIGHT"

and the corresponding arrow mark "⇦" and can recognize that there is a vehicle V1 approaching the intersection from the right side on the preferred road $R_A$.

On the other hand, if it is determined that the received signal has the frequency $f_1$, information indicating that there is a vehicle approaching the intersection from the side with the magnetic marker $\mathbf{100}_L$ on the preferred road $R_A$ is supplied to the display unit 302. As a result, the display unit 302 lights, as shown in FIG. 6, a direction indicator "LEFT" and a corresponding arrow mark "⇨". The driver of the vehicle V3 approaching the intersection on the non-preferred road $R_B$ looks at the direction indicator "LEFT" and the corresponding arrow mark "⇨" and can recognize that there is a vehicle V2 approaching the intersection from the left side on the preferred road $R_A$.

When the vehicle V1 or V2 running on the preferred road $R_A$ detects the magnetic marker $\mathbf{100}_{Re}$ or $\mathbf{100}_{Le}$, the transmission of the signal is stopped. At this time, the receiving apparatus 200 stops receiving the signal. As a result, the display on the display apparatus 300 is turned off.

In the above system, the signal transmitted from the vehicle V1 or V2 running on the preferred road $R_A$ includes the information (the frequency $f_r$ or $f_1$) indicating from which side a vehicle is approaching the intersection. The signal transmitted from the vehicle Vi or V2 may further include other information. For example, a degree of an emergency defined based on the time t required for the vehicle V1 or V2 to reach the intersection may be included in the transmission signal. The smaller the time t, the higher the degree of the emergency. In this case, the display apparatus 300 can change displayed contents (e.g., a displayed color) in accordance with the degree of the emergency included in the signal received by the receiving apparatus 200.

In addition, in the above system, when the magnetic marker $\mathbf{100}_{Re}$ or $\mathbf{100}_{Le}$ is detected, it is determined that the vehicle has reached the intersection (the termination of service). It may be determined whether the vehicle has reached the intersection based on the running distance from the magnetic marker $\mathbf{100}_R$ or $\mathbf{100}_L$ installed before the intersection. The running distance is calculated based on the detecting signal from the vehicle speed sensor 12.

Figure 7:
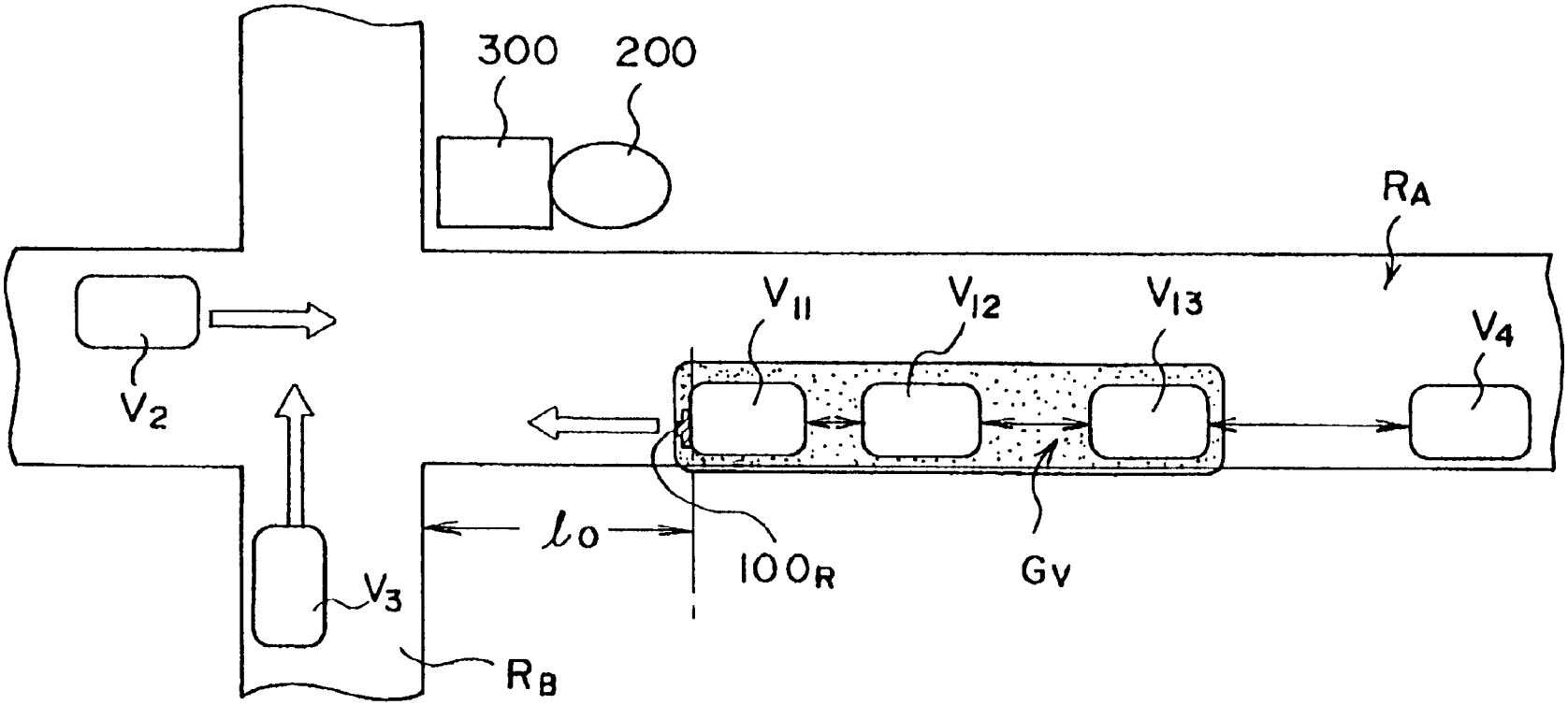
FIG. 7 is a diagram illustrating states of vehicles near the intersection to which the intersection information supply system is applied.

There is a case, as shown in FIG. 7, for example, where a plurality of vehicles V11, V12 and V13 continuously arranged at relatively short intervals (so that another vehicle can not wedge between the vehicles) are approaching the intersection on the preferred road $R_A$. In this case, it is important that the driver of the vehicle V3 approaching the intersection on the non-preferred road $R_B$ be informed that the vehicles as a vehicle group $G_v$ are approaching the intersection. From this point of view, the following intersection information supply system is proposed.

Figure 8:
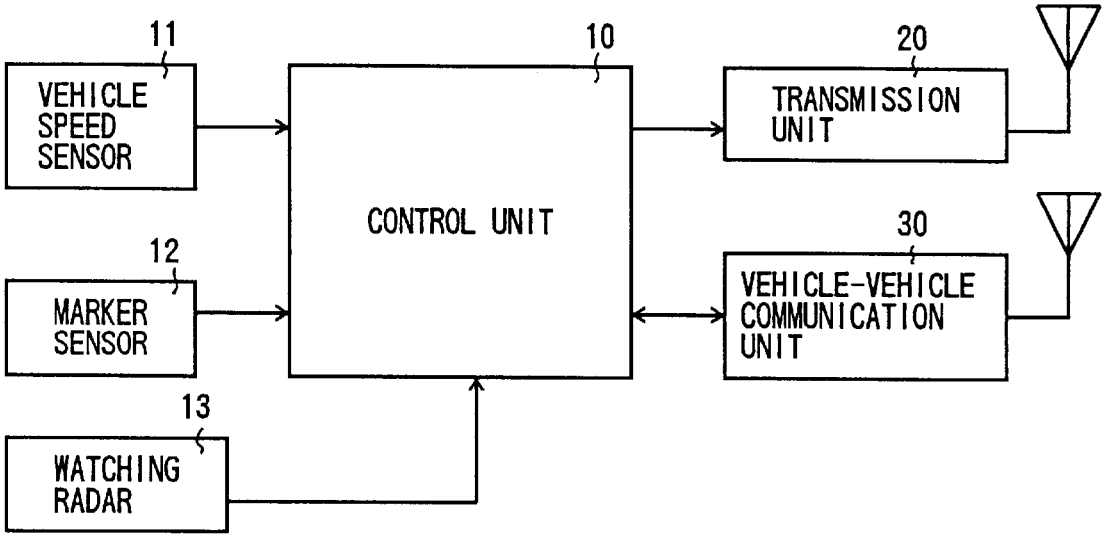
FIG. 8 is a block diagram illustrating another example of the constitution of the onboard information transmission apparatus.

The onboard information transmission apparatus provided in each of the vehicles V11, V12, V13 and V4 running on the preferred road $R_A$ is formed as shown in FIG. 8. In FIG. 8, those parts which are the same as those shown in FIG. 2 are given the same reference numbers.

Referring to FIG. 8, the onboard information transmission apparatus has the control unit 10 generating the control signals based on the detecting signals from the vehicle speed sensor 11 and the marker sensor 12 and the transmission unit 20 for which the transmission control and the frequency control are carried out based on the control signals in the same manner as that shown in FIG. 2. The onboard information transmission apparatus further has a watching radar 13 for watching the forward area and a vehicle-vehicle communication unit 30. The vehicle-vehicle communication unit 30 is used to communicate between vehicles within a predetermined distance. The watching radar 13 is used to detect the distance to a body, such as a preceding vehicle, in the forward area of the vehicle.

Figure 9:
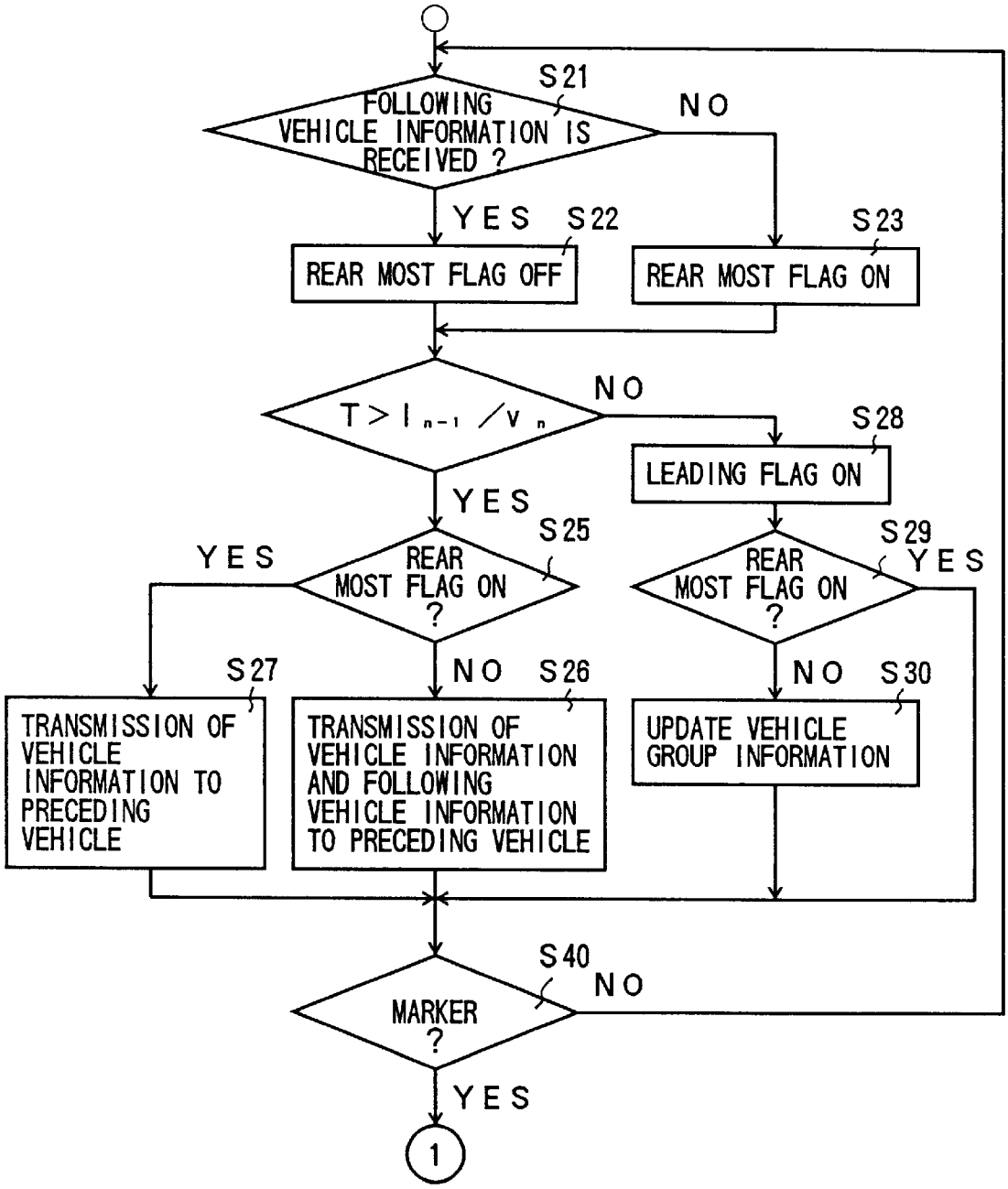
FIG. 9 is a flowchart illustrating a procedure of a process executed by a control unit of the onboard information transmission apparatus shown in FIG. 8 (the first)
Figure 10:
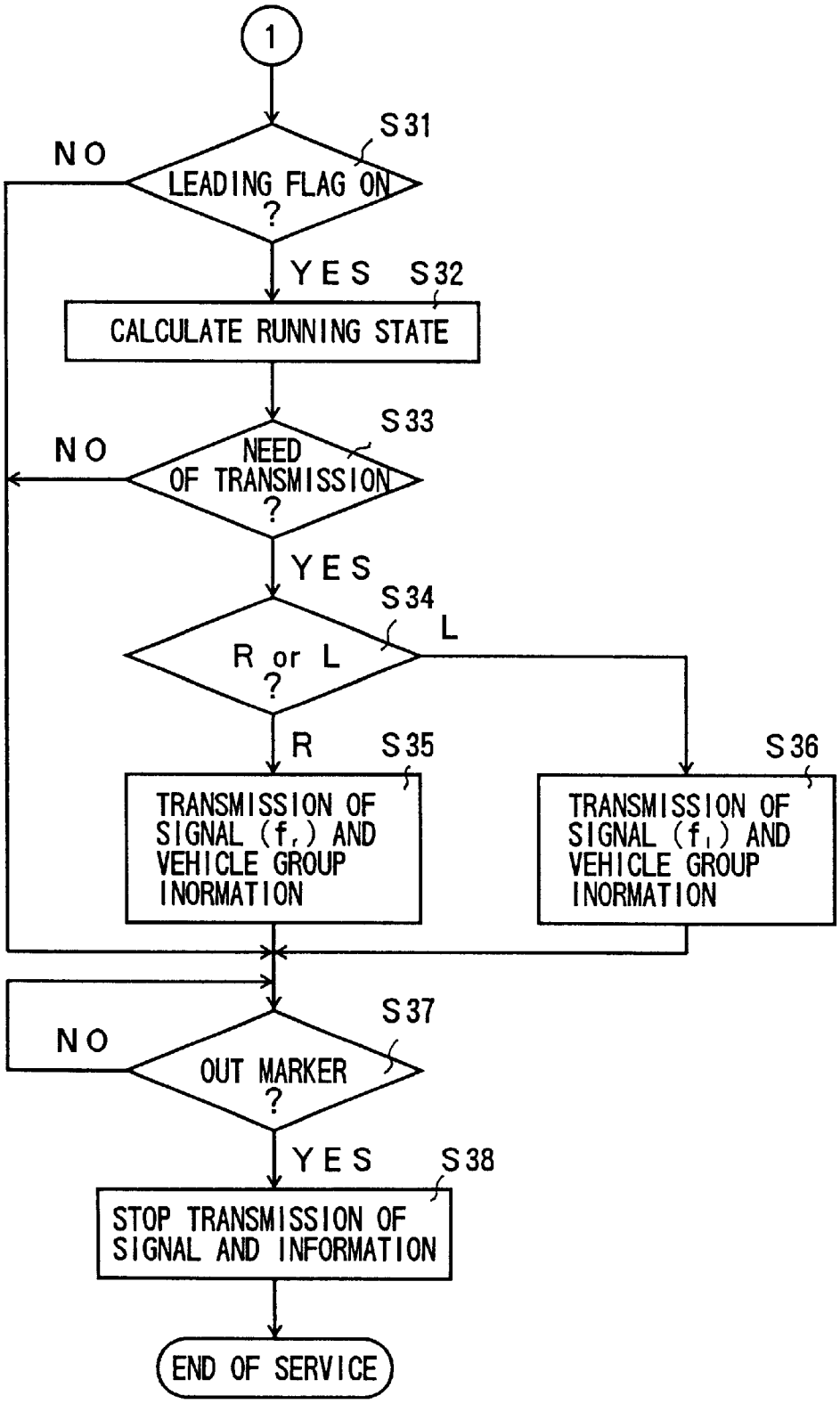
FIG. 10 is a flowchart illustrating a procedure of a process executed by the control unit of the onboard information transmission apparatus shown in FIG. 8 (the second)

The control unit 10 of the onboard transmission apparatus carries out a process in accordance with a procedure as shown in FIGS. 9 and 10.

Referring to FIG. 9, It is determined whether the vehicle-vehicle communication unit 30 receives information about a following vehicle (following vehicle information) from the following vehicle (S21). If the following vehicle information is received from the following vehicle, it is determined that the vehicle is not the rearmost vehicle and a rearmost flag is turned off (S22). On the other hand, if the following vehicle information is not received, it is determined that the vehicle is the rearmost vehicle and the rearmost flag is turned on (S23). After this, a value $(l_{n-1}/v_n)$ is calculated based on the vehicle speed $v_n$ and the distance $l_{n-1}$ between the vehicle and the preceding vehicle. The vehicle speed $v_n$ is calculated based on the detecting signal from the vehicle speed sensor 11. The distance $l_{n-1}$ is calculated based on the detecting signal from the watching radar 13. The value $(l_{n-1}/v_n)$ represents a degree of approach of the vehicle to the preceding vehicle. It is then determined whether the value $(l_{n-1}/v_n)$ is less than a predetermined threshold T (having a dimension of time) (S24). The threshold T is decided as a value corresponding to a time period margin in which another vehicle can wedge between the vehicle and the preceding vehicle.

If the calculated value $(l_{n-1}/v_n)$ is less than the threshold T, that is, if there is no time period margin in which another vehicle can wedge between the vehicle and the preceding vehicle, it is determined that the vehicle is in a vehicle group $G_v$. It is further determined whether the rearmost flag is in the on state (S25). If the rearmost flag is not in the on state, the vehicle is not the rearmost vehicle in the vehicle group $G_v$. Thus, in this case, the vehicle-vehicle communication unit 30 transmits information about the vehicle (vehicle information) and following vehicle information received from the following vehicle to the preceding vehicle (S26). The vehicle information includes information about the vehicle speed $v_n$ of the vehicle and the distance $l_{n-1}$ between the vehicle and the preceding vehicle. The following vehicle information includes information about vehicle speeds of all following vehicles arranged after the vehicle so that there is not a time period margin in which another vehicle can be wedge inbetween, a distance between the vehicle and an iediately following vehicle and distances between the following vehicles.

On the other hand, if the rearmost flag is in the on state, the vehicle is the rearmost vehicle in the vehicle group $G_v$. Thus, in this case, the vehicle-vehicle communication unit 30 transmits the vehicle information including the vehicle speed $v_n$ and the distance $l_{n-1}$ between the vehicle and the preceding vehicle to the preceding vehicle (S27).

In addition, on the other hand, if the calculated value $(l_{n-1}/v_n)$ is equal to or greater than the threshold T, that is, if there is the time period margin in which another vehicle can wedge between the vehicle and the preceding vehicle, it is determined that the vehicle is a leading vehicle. A leading flag is then turned on (S28). The leading vehicle is either a vehicle at the leading position in the vehicle group $G_v$ or a single vehicle which is not included in the vehicle group $G_v$. It is further determined whether the rearmost flag is in the on state (S29). If the rearmost flag is not in the on state, the vehicle is a leading vehicle in the vehicle group $G_v$. Vehicle group information is then updated (generated) based on the following vehicle information received from the following vehicle and the vehicle information about the vehicle (S30). The vehicle group information includes information about at least the vehicle which is the leading vehicle of the vehicle group $G_v$ and the total number of the following vehicles arranged after the vehicle in the vehicle group $G_v$.

If it is determined, after the leading flag is turned on, that the rearmost flag is in the on state (YES in S29), the vehicle is a single vehicle which is not included in the vehicle group $G_v$. In this case, the vehicle group information is not updated. The above process is repeatedly performed until the magnetic marker $\mathbf{100}_R$ installed at a predetermined position before the intersection (see FIG. 7) is detected in the vehicle (YES in S40). While the process is repeatedly performed, the vehicle group information (the number of vehicles included in the vehicle group) is updated based on distances between vehicles and vehicle speeds of the vehicles.

In the process as described above, when the magnetic marker $\mathbf{100}_R$ is detected, the process proceeds to steps shown in FIG. 10.

Referring to FIG. 10, it is determined whether the leading flag is in the on state (S31). When the leading flag is in the on state, that is, when the vehicle is the leading vehicle (either a single vehicle which is not included in the vehicle group or a leading vehicle in the vehicle group), the running state (the time t) of the vehicle (the leading vehicle) is calculated based on the detecting signal from the vehicle speed sensor 11 in the same manner as the process shown in FIG. 4 (see step S2) (S32). It is then determined whether a signal should be transmitted to inform of the presence of a vehicle in the calculated running state (S33). If it is determined that the signal should be transmitted, it is then determined, based on the polarizing pattern of the magnetic field detected by the marker sensor 12, from which side the vehicle is approaching the intersection (S34).

If it is determined that the vehicle is approaching the intersection from the side with the magnetic marker 100R (the right side of the intersection in FIG. 7), the control unit 10 supplies a control signal to transmit a radio signal having a frequency $f_r$ and the vehicle group information to the transmission unit 20 (S35). As a result, the radio signal, including the vehicle group information, having the frequency $f_r$ is transmitted from the transmission unit 20 of the leading vehicle V11 of the vehicle group $G_v$ (see FIG. 7). On the other hand, if it is determined that the vehicle is approaching the intersection from the side with the magnetic marker $\mathbf{100}_L$ (the left side of the intersection in FIG. 7), the control unit 10 supplies a control signal to transmit a radio signal having a frequency $f_1$ and the vehicle group information to the transmission unit 20 (S36). As a result, the radio signal, including the vehicle group information, having the frequency $f_1$ is transmitted from the transmission unit 20 of the leading vehicle of the vehicle group.

After this, in the same manner as in the process shown in FIG. 4, it is determined whether the magnetic marker (the out marker) installed in the intersection is detected (S37). Wen the magnetic marker is detected, the control unit 10 outputs a control signal to stop transmission of the radio signal to the transmission unit 20 (S38). As a result, the transmission unit 20 stops transmitting the radio signal having the frequency $f_r$ or $f_1$. The respective vehicles V11, V12 and V13 ranged in the vehicle group $G_v$ successively pass through the intersection.

In each of the vehicles V12 and V13 which are not the leading vehicle in the vehicle group Gv, it is determined that the leading flag is not in the on state (S31). In this case, steps S32–S36 are not executed. In addition, if it is determined that the signal is not needed to be transmitted to inform of the presence of a vehicle in the calculated running state (No in S33), steps S34–S36 are not executed.

In the above-described case, the control unit 301 of the display unit 300 installed near the intersection carries out the process in accordance with the same procedure as the process shown in FIG. 5.

Figure 11:
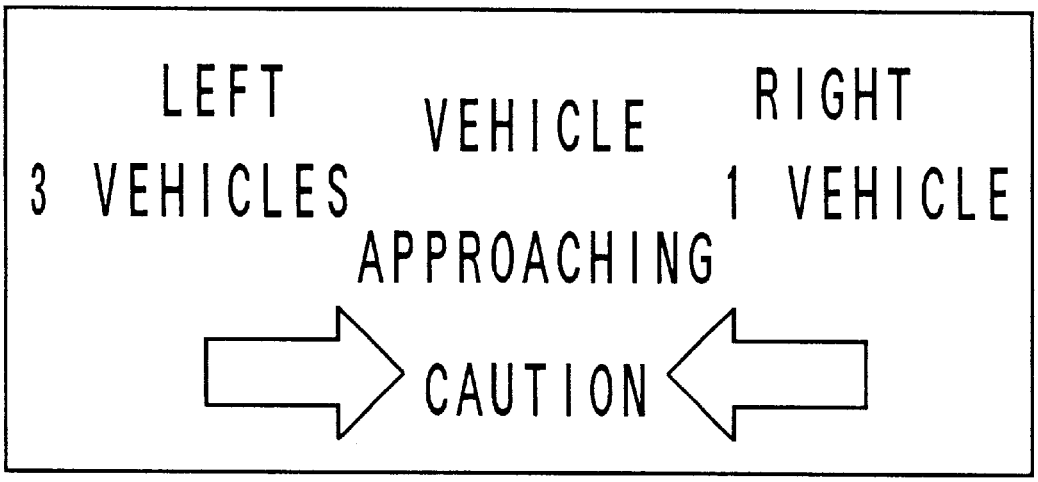
FIG. 11 is a diagram illustrating another example of information displayed by the display unit of the roadside apparatus.

That is, when the receiving apparatus 200 receives the signal from the leading vehicle, in the vehicle group $G_v$, running toward the intersection on the preferred road $R_A$, the frequency of the received signal is checked. The display control of the display unit 302 is carried out based on the checking result. The total number of vehicles included in the vehicle group Gv (e.g., "3") is obtained from the vehicle group information and displayed, as shown in FIG. 11, in the display unit 302 in addition to the direction ("RIGHT" or "LEFT") corresponding to the frequency of the received signal and the corresponding arrow.

The driver of the vehicle V3 approaching the intersection on the non-preferred road RB looks at the information (the direction, the corresponding arrow and the total number of vehicles in the vehicle group) displayed on the display unit 302. As a result, the driver can recognize that there is the vehicle group Gv of three vehicles (V11, V12 and V13) approaching the intersection from the right side of the intersection.

The present invention is not limited to the aforementioned embodiments, and other variations and modifications may be made without departing from the scope of the claimed invention.

The present application is based on Japanese priority application No.9-264523 filed on Sep. 29, 1997, the entire contents of which are hereby incorporated by reference.

What is claimed is:

1. An onboard information transmission apparatus provided in a vehicle comprising:

approaching detecting means for detecting that the vehicle approaching an intersection on a first road reaches a position at a predetermined distance before the intersection, the first road and a second road intersecting at the intersection;

signal transmission means for transmitting a predetermined signal when said approaching detecting means detects that the vehicle reaches the position at the predetermined distance before the intersection, wherein the predetermined signal transmitted by said signal transmission means is used to supply information, indicating that there is the vehicle approaching the intersection on the first road, to another vehicle approaching the intersection on the second road;

running state detecting means for detecting a running state of the vehicle; and transmission control means for controlling, based on the detecting result obtained by said running state detecting means, the transmission of the predetermined signal by said signal transmission means, wherein said running state detecting means comprises time estimating means for estimating a time period from a time said approaching detecting means detects that the vehicle reaches the position at the predetermined distance before the intersection to a time the vehicle reaches the intersection, and wherein said transmission control means comprises determination means for determining whether the time period obtained by said time estimating means is less than a predetermined value, said transmission control means causing said signal transmission means to transmit the predetermined signal when said determination means determines that the estimated time period is less than the predetermined value.

2. The onboard information transmission apparatus as claimed in claim 1, wherein said approaching detecting means has means to detecting from which side of the intersection the vehicle reaches the position the predetermined distance before the intersection, wherein the predetermined signal transmitted by said signal transmission means includes information indicating that the vehicle is approaching the intersection from a side based on the detecting result obtained by said means.

3. The onboard information transmission system as claimed in claim 1, wherein the running state of the vehicle includes one selected from the group consisting of running speed, acceleration, and a time period needed to reach the intersection.

4. The onboard information transmission apparatus as claimed in claim 1 further comprising:

following vehicle state detecting means for detecting a presence state of one or a plurality of following vehicles in a rearward area of the vehicle; and vehicle group information generating means for generating, based on the presence of the one or the plurality of following vehicles detected by said following vehicle state detecting means, information about a vehicle group of the vehicle and the one or the plurality of following vehicles, wherein the predetermined signal transmitted by said signal transmission means includes the information about the vehicle group generated by said vehicle group information generating means.

5. An onboard information transmission apparatus provided in a vehicle comprising:

an approaching detecting unit detecting that the vehicle approaching an intersection on a first road reaches a position at a predetermined distance before the intersection, the first road and a second road intersecting at the intersection;

a signal transmission unit transmitting a predetermined signal when said approaching detecting unit detects that the vehicle reaches the position at the predetermined distance before the intersection, wherein the predetermined signal transmitted by said signal transmission unit is used to supply information, indicating that there is the vehicle approaching the intersection on the first road, to another vehicle approaching the intersection on the second road; and a running state detecting unit detecting a running state of the vehicle; and a transmission control unit controlling, based on the detecting result obtained by said running state detecting unit, the transmission of the predetermined signal by said signal transmission unit, wherein said running state detecting means comprises a time estimating unit estimating a time period from a time said approaching detecting unit detects that the vehicle reaches the position at a predetermined distance before the intersection to a time the vehicle reaches the intersection, and wherein said transmission control means comprises a determination unit determining whether the time period obtained by said time estimating unit is less than a predetermined value, said transmission control unit causing said signal transmission unit to transmit the predetermined signal when said determination unit determines that the estimated time period is less than the predetermined value.

6. The onboard information transmission apparatus as claimed in claim 5, wherein said approaching detecting unit has a unit detecting from which side of the intersection the vehicle reaches the position the predetermined distance before the intersection, wherein the predetermined signal transmitted by said signal transmission unit includes information indicating that the vehicle is approaching the intersection from a side based on the detecting result obtained by said unit.

7. The onboard information transmission system as claimed in claim 5, wherein the running state of the vehicle includes one selected from the group consisting of running speed, acceleration, and a time period needed to reach the intersection.

8. An onboard information transmission apparatus in a vehicle comprising:

an approaching detecting unit detecting that the vehicle approaching an intersection on a first road reaches a position at a predetermined distance before the intersection, the first road and a second road intersecting at the intersection;

a signal transmission unit transmitting a predetermined signal when said approaching detecting unit detects that the vehicle reaches the position at the predetermined distance before the intersection, wherein the predetermined signal transmitted by said signal transmission unit is used to supply information, indicating that the vehicle is approaching the intersection on the first road, to another vehicle approaching the intersection on the second road;

a following vehicle state detecting unit detecting a presence state of one or a plurality of following vehicles in a rearward area of the vehicle; and a vehicle group information generating unit generating, based on the presence of the one or the plurality of following vehicles detected by said following vehicle state detecting unit, information about a vehicle group including the vehicle and the one or the plurality of following vehicles, wherein said signal transmission unit transmits the predetermined signal including the vehicle group information generated by said vehicle group information generating unit, such that said predetermined signal is used to supply the vehicle group information to another vehicle approaching the intersection on the second road.

* * * * *